US007657203B2

(12) United States Patent
Iijima

(10) Patent No.: US 7,657,203 B2
(45) Date of Patent: Feb. 2, 2010

(54) IMAGE FORMING APPARATUS WITH DRIVE LOAD FLUCTUATION CORRECTION UNIT

(75) Inventor: Kiichiroh Iijima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 335 days.

(21) Appl. No.: 11/403,900

(22) Filed: Apr. 14, 2006

(65) Prior Publication Data

US 2007/0065186 A1 Mar. 22, 2007

(30) Foreign Application Priority Data

Sep. 21, 2005 (JP) ..... P2005-274216

(51) Int. Cl.
*G03G 15/16* (2006.01)

(52) U.S. Cl. ..... 399/101; 399/302

(58) Field of Classification Search ..... 399/40, 399/51, 66, 101, 178, 179, 180, 181, 302, 399/308; 347/115, 129, 224, 232; 358/534, 358/536

See application file for complete search history.

(56) References Cited

U.S. PATENT DOCUMENTS

| | | | | |
|---|---|---|---|---|
| 5,404,156 | A * | 4/1995 | Yamada et al. | 347/115 |
| 5,469,266 | A * | 11/1995 | Usami et al. | 358/1.9 |
| 5,572,330 | A * | 11/1996 | Sasanuma | 358/406 |
| 5,652,948 | A * | 7/1997 | Sakaguchi et al. | 399/66 |
| 6,121,997 | A * | 9/2000 | Fukushima | 347/261 |
| 6,133,927 | A * | 10/2000 | Arai et al. | 347/131 |
| 6,226,021 | B1 * | 5/2001 | Kobayashi et al. | 347/183 |
| 6,819,902 | B2 * | 11/2004 | Toyohara et al. | 399/298 |
| 7,034,858 | B2 * | 4/2006 | Oba et al. | 347/237 |
| 2004/0190031 | A1 * | 9/2004 | Fujita | 358/1.9 |
| 2007/0264050 | A1 * | 11/2007 | Ishida | 399/223 |

FOREIGN PATENT DOCUMENTS

| | | | |
|---|---|---|---|
| JP | 04105961 | A * | 4/1992 |
| JP | 05019589 | A * | 1/1993 |

(Continued)

OTHER PUBLICATIONS

Fuji Xerox Technical Report No. 11, 1996, "World's Fastest Digital Full Colour Copy Machine DocuColor 4040", pp. 112-119.

(Continued)

*Primary Examiner*—Robert Beatty
(74) *Attorney, Agent, or Firm*—Morgan, Lewis & Bockius LLP

(57) ABSTRACT

An image forming apparatus includes an image carrier that a plurality of toner images of differing colors are formed on a surface, and an intermediate transfer belt positioned opposite the image carrier, the toner images formed on the image carrier being primarily transferred onto an intermediate transfer belt in a superimposed condition, and being collectively secondarily transferred from the intermediate transfer belt onto a transfer material, and the toner images of the two colors set to be approximately identical in screen angle being consecutively transferred in a superimposed condition onto the intermediate transfer belt. A drive load fluctuation correction unit corrects the drive load to the intermediate transfer belt in accordance with a cleaning device moving into and out of engagement with the intermediate transfer belt.

11 Claims, 15 Drawing Sheets

FOREIGN PATENT DOCUMENTS

| | | | |
|---|---|---|---|
| JP | 6-133175 | | 5/1994 |
| JP | 9-185213 | | 7/1997 |
| JP | 2000066529 | A * | 3/2000 |
| JP | 2000-152015 | | 5/2000 |
| JP | 2002-31926 | | 1/2002 |
| JP | 2002-202706 | | 7/2002 |
| JP | 2004122383 | A * | 4/2004 |

OTHER PUBLICATIONS

"A Basic Knowledge of Printing Terminology 200" (Kakio Shinichi version, issued by Printing Society Publishing Department, p. 106.

* cited by examiner

SCREEN ANGLE = 0°C

SCREEN ANGLE = 30°C

SCREEN ANGLE = 60°C

SCREEN ANGLE = 90°C

| COLOUR | YELLOW (Y) | MAGENTA (M) | CYAN (C) | BLACK (K) |
|---|---|---|---|---|
| SCREEN ANGLE | 0°C | 30°C | 30°C | 60°C |

FIG. 8 (A)
YELLOW (Y)
SCREEN ANGLE = 0°C
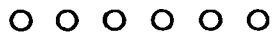
FIG. 8 (B)
MAGENTA (M)
SCREEN ANGLE = 30°C
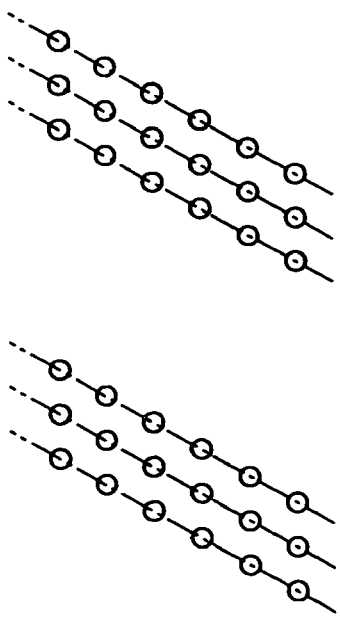
FIG. 8 (C)
CYAN (C)
SCREEN ANGLE = 30°C
FIG. 8 (D)
BLACK (K)
SCREEN ANGLE = 60°C
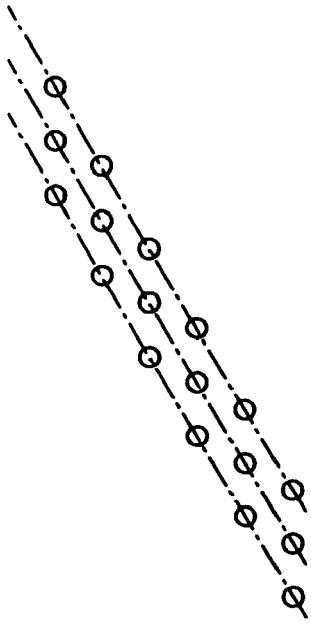

FIG. 11 (A)

| COLOUR | BLACK (K) | YELLOW (Y) | MAGENTA (M) | CYAN (C) |
|---|---|---|---|---|
| SCREEN ANGLE | 0℃ | 30℃ | 30℃ | 60℃ |

FIG. 11 (B)

| COLOUR | YELLOW (Y) | BLACK (K) | CYAN (C) | MAGENTA (M) |
|---|---|---|---|---|
| SCREEN ANGLE | 0℃ | 30℃ | 30℃ | 60℃ |

FIG. 12

| COLOUR | YELLOW (Y) | MAGENTA (M) | CYAN (C) | BLACK (K) |
|---|---|---|---|---|
| SCREEN ANGLE | 0℃ | 30℃ | 60℃ | 60℃ |

IMAGE FORMING APPARATUS WITH DRIVE LOAD FLUCTUATION CORRECTION UNIT

BACKGROUND

1. Technical Field

The present invention relates to an image forming apparatus such as a printer and a copy machine employing an electrophotographic system or the like, or a facsimile, and more particularly to an image forming apparatus which, after temporarily transferring a toner image formed on an image carrier onto an intermediate transfer belt, forms an image by transferring the toner image onto a transfer medium.

2. Related Art

Among image forming apparatus of this kind such as a printer and a copy machine employing an electrophotographic system or the like, or a facsimile, as an image forming apparatus capable of forming a full color image, various so-called multipath (4 cycle) type image forming apparatus configured as follows have been previously proposed and commercialized. The configuration is such as to include a single photoreceptor drum, to form in order a toner image for each of the colors yellow (Y), magenta (M), cyan (C) and black (K) on the photoreceptor drum then, after primarily transferring the toner image for each of the colors yellow (Y), magenta (M), cyan (C) and black (K) formed in order on the photoreceptor drum in a mutually superimposed condition onto an intermediate transfer belt, to form a full color image by secondarily transferring from the intermediate transfer belt onto a paper which forms a recording medium.

This kind of multipath (4 cycle) type image forming apparatus employs a synchronization configuration wherein a peripheral length of the intermediate transfer belt is set to be an integral multiple of the peripheral length of a drive roller which drives the intermediate transfer belt, thereby reducing the incidence of color drift due to a frequency fluctuation of the drive roller caused by a bias or the like.

However, even an image forming apparatus employing the synchronization configuration has the following problems which cause color irregularity and other reductions in image quality. That is, an error exists in tolerance and the like in peripheral length of the intermediate transfer belt, and the peripheral length of the intermediate transfer belt varies (extends and contracts) due to environmental changes in temperature, humidity and the like. Furthermore, an error occurs in the synchronization configuration of the peripheral lengths of the intermediate transfer belt and the drive roller due to a load fluctuation when the cleaner which cleans the surface of the intermediate transfer belt comes into and out of contact therewith.

Also, in the case of photographic image quality, as a granularity of a person's "flesh color" is important, yellow, magenta and cyan are staggered by 30 degrees, but this unit that black (K), which has a high visible sensitivity as color irregularity, has the same or similar screen angle (15 degrees or less) as one of the colors yellow, magenta and cyan. As a result, although it is not inevitable that the screen angle of the black image is absolutely identical to the screen angle of another color, a problem exists wherein in the event that setting is done in such a way that the black image deviates by 15 degrees between the images of the other two colors, two kinds of interference are conspicuous, meaning that the moiré is even more conspicuous than in the case of approximately identical angles.

Furthermore, in the case of a digital type screen, as it is not possible to make the line frequency of each color identical and deviate neatly by, for example, 15 degrees or 30 degrees, there is a slight deviation of angle (for example 13 degrees or 27 degrees), meaning that the appearance of the moiré changes depending on the line frequency and resolution. As a result, when looking for an appropriate place while evaluating granularity and the like within a range of 0 to 15 degrees, considering the image quality design parameters, development, transfer and the like, it is preferable to set identical angles for the screen angles of 2 colors, with this setting becoming a necessary condition for the maintenance of photographic image quality. As a result, even though it is becoming extremely important to prevent the occurrence of a large color irregularity between two colors with an equivalent or approximately equivalent screen angle, a problem exists according to the aforementioned related arts wherein it is unable to prevent the occurrence of a large color irregularity between two colors with an equivalent or approximately equivalent screen angle.

SUMMARY

The present invention has been made in view of the above circumstances and provides an image forming apparatus.

According to an aspect of the invention, an image forming apparatus comprises: an image carrier that a plurality of toner images of differing colors are formed on a surface of the image carrier; and an intermediate transfer belt positioned opposite the image carrier, the toner images formed on the image carrier being primarily transferred onto an intermediate transfer belt in a superimposed condition, and being collectively secondarily transferred from the intermediate transfer belt onto a transfer material, and the toner images of the two colors set to be approximately identical in screen angle being consecutively transferred in a superimposed condition onto the intermediate transfer belt.

BRIEF DESCRIPTION OF THE DRAWINGS

Embodiment(s) of the present invention will be described in detail based on the following figures, wherein:

FIGS. 8 (A) to (D) are schematic diagrams showing a screen angle of a toner image of each color in the color image forming apparatus as the image forming apparatus according to the first embodiment of the invention;

FIGS. 11(A) and (B) are charts showing a screen angle of a toner image of each color in a modified example of the color image forming apparatus as the image forming apparatus according to the first embodiment of the invention;

FIG. 12 is a chart showing a screen angle of a toner image of each color in a modified example of the color image forming apparatus as the image forming apparatus according to the first embodiment of the invention;

DETAILED DESCRIPTION

An embodiment of the invention will be described with reference to the drawings.

FIRST EMBODIMENT

Figure 1:
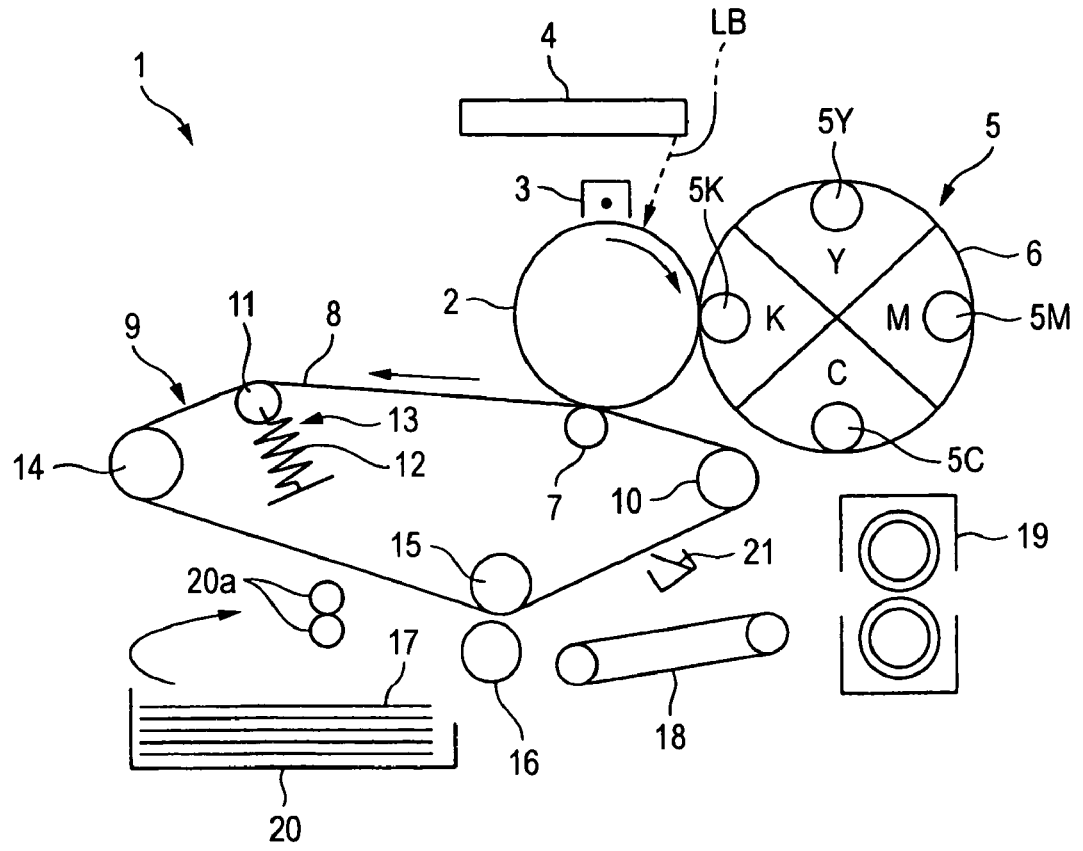
FIG. 1 is a configuration diagram showing a color image forming apparatus as an image forming apparatus according to a first embodiment of the invention.
Figure 2:
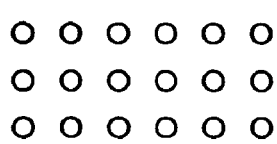
FIGS. 2(A) to (D) are explanatory diagrams showing a screen used in the color image forming apparatus as the image forming apparatus according to the first embodiment of the invention.
Figure 2:
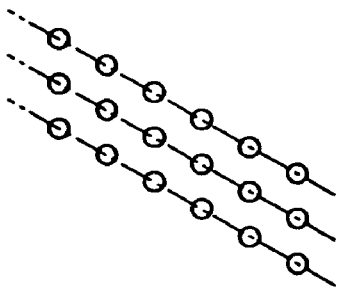
Figure 2:
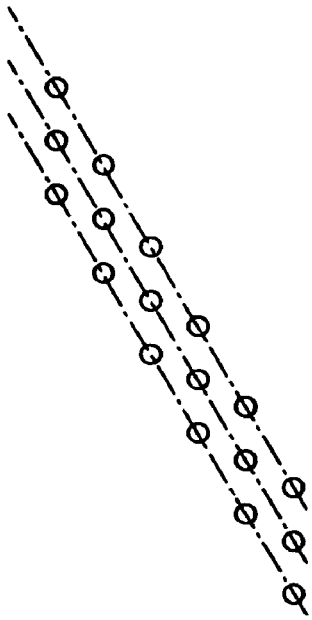
Figure 2:
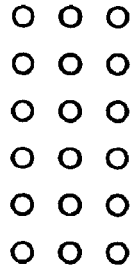

FIG. 1 is an outline configuration diagram showing a multipath (4 cycle) type color image forming apparatus as an image forming apparatus according to a first embodiment.

As shown in FIG. 1, the color image forming apparatus 1 is provided with a singular (1) photoreceptor drum 2 as an image carrier, the photoreceptor drum 2 comprising an electrically conductive cylindrical body on the surface of which a photoreceptive layer of OPC, amorphous silicon or the like is formed. The photoreceptor drum 2 is configured in such a way that it is driven to rotate at a prescribed speed in a clockwise direction by not-shown driving unit.

The surface of the photoreceptor drum 2 is charged uniformly at a prescribed potential by a charger 3 including Scorotron, a charging roll and the like. Thereafter, image exposure is applied to the surface of the photoreceptor drum 2 in order by a laser beam LB, in accordance with an image information from each of the colors yellow (Y), magenta (M), cyan (C) and black (B), by unit of an optical write unit 4 such as an ROS (Raster Output Scanner). An electrostatic latent image corresponding to each color is thus formed on the surface of the photoreceptor drum 2. In the optical write unit 4, image exposure for each color is carried out using a line screen, with a setting being such that a screen angle of the line screen differs according to the color.

According to the embodiment, as will be described hereafter, the electrostatic latent image corresponding to a first color, yellow (Y), the electrostatic latent image corresponding to a second color, magenta (M), the electrostatic latent image corresponding to a third color, cyan (C), and the electrostatic latent image corresponding to a fourth color, black (K), are each formed in order.

Also, the electrostatic latent image formed on the photoreceptor drum 2 is developed by a developer of a corresponding color on a rotary developing apparatus 5, forming a toner of the corresponding color. The rotary developing apparatus 5 comprises a developer 5Y, 5M, 5C and 5K for each of the colors yellow (Y), magenta (M), cyan (C) and black (K) distributed along a circumferential direction of a rotatably configured developing device body 6, and is configured in such a way as to develop the electrostatic latent image for the prescribed color by moving the developer 5Y, 5M, 5C, 5K of the color to be developed to a developing position corresponding to the photoreceptor drum 2.

A toner image for each of the colors yellow (Y), magenta (M), cyan (C) and black (K) formed in order on the surface of the photoreceptor drum 2 is primarily transferred, by unit of a primary transfer roller 7, in a mutually superimposed condition onto an intermediate transfer belt 8. The intermediate transfer belt 8 is positioned below the photoreceptor drum 2 in unit form as an intermediate transfer belt unit 9, being brought into contact with the surface of the photoreceptor drum 2 by unit of the primary transfer roller 7. The intermediate transfer belt 8 is stretched at a prescribed tension, and driven in such a way as to move cyclically at approximately the same speed as the photoreceptor drum, by a plurality of rollers including a drive roller 10, which is rotary driven by not-shown driving unit, the primary transfer roller 7, a tension roller 11 which, together with a tension spring 12 which adds tension, forms a tension unit 13, a stretching roller 14, and a backup roller 15.

The toner image for each of the colors yellow (Y), magenta (M), cyan (C) and black (K) primarily transferred in a mutually superimposed condition onto the intermediate transfer belt 8 is secondarily transferred, by unit of a secondary transfer roller 16, onto a transfer paper 17 as a transfer material. Thereafter, the toner image is conveyed to a fuser 19 by a conveyor belt 18, and fixed onto the transfer paper 17 via the fuser 19 by heat and pressure, thus forming a color image. The transfer paper 17 is fed from a paper tray 20 according to a prescribed timing, and conveyed by a resist roller 20*a* to a secondary transfer position on the intermediate transfer belt 8 in a condition synchronized with the toner image transferred onto the intermediate transfer belt 8.

Also, as shown in FIG. 1, the transfer residual toner remaining on the surface of the intermediate transfer belt 8 is removed by a belt cleaner (cleaning member) 21, which acts as an engaging/disengaging member capable of moving into and out of contact with the surface of the intermediate transfer belt 8 according to a prescribed timing. The belt cleaner 21 comprises, for example, a cleaning blade which comes into contact with the surface of the intermediate transfer belt 8, thus removing the transfer residual toner. Also, the belt cleaner 21 is installed in such a way as to come into and out of contact with the intermediate transfer belt 8, which is stretched between the drive roller 10 and the back up roller 15.

Figure 3:
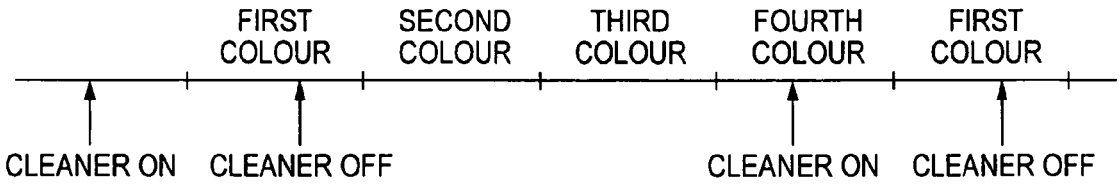
FIG. 3 is a timing chart showing the timing whereby a belt cleaner comes into and out of contact with an intermediate transfer belt in the color image forming apparatus as the image forming apparatus according to the first embodiment of the invention.

As shown in FIG. 3, when seen from the primary transfer position, the belt cleaner 21 is configured in such a way as to come into contact with the surface of the intermediate transfer belt 8 while the toner image of the fourth color is being transferred from the photoreceptor drum onto the intermediate transfer belt 8, and to come out of contact with the surface of the intermediate transfer belt 8 while the toner image of the first color is being transferred from the photoreceptor drum onto the intermediate transfer belt 8.

Figure 4:
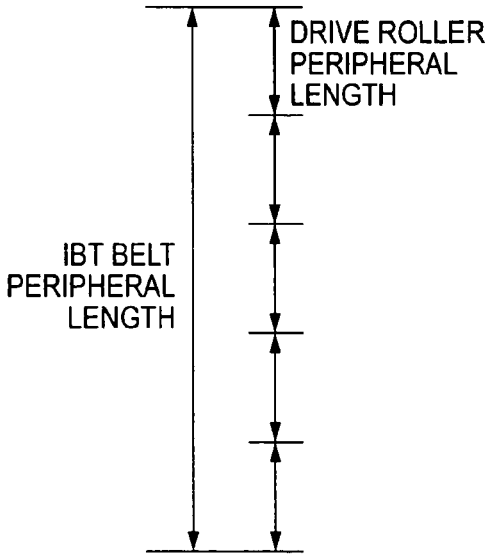
FIG. 4 is an explanatory diagram showing a synchronized condition of the intermediate transfer belt and a drive roller.

According to the embodiment, however, as shown in FIG. 4, a peripheral length of the intermediate transfer belt 8 is set to be an integral multiple (for example, 5 times) of the peripheral length of the drive roller 10, being configured in such a way that the rotation of the intermediate transfer belt 8 and the rotation of the drive roller 10 are synchronized. Consequently, even in a case of the existence of a periodic rotational fluctuation caused by a bias or the like in the rotation of the drive roller 10, as the rotation of the drive roller 10 and the rotation of the intermediate transfer belt 8 are synchronized, by transferring the toner image for each of the colors yellow (Y), magenta (M), cyan (C) and black (K) to the same position on the intermediate transfer belt 8, the toner image for each color can be transferred in a mutually superimposed condition without being affected by the bias or the like in the drive roller 10.

Figure 5:
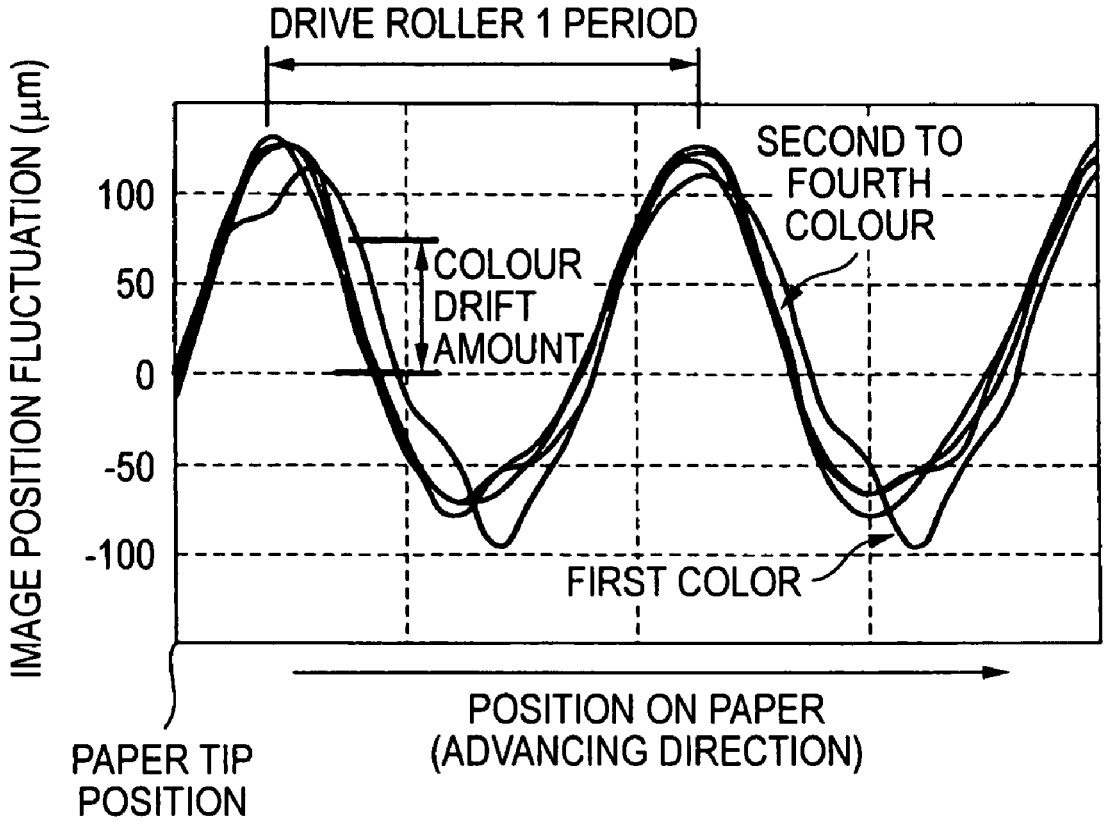
FIG. 5 is a graph showing an image position fluctuation of a toner image of each color which is transferred onto a paper.
Figures 6, 7:
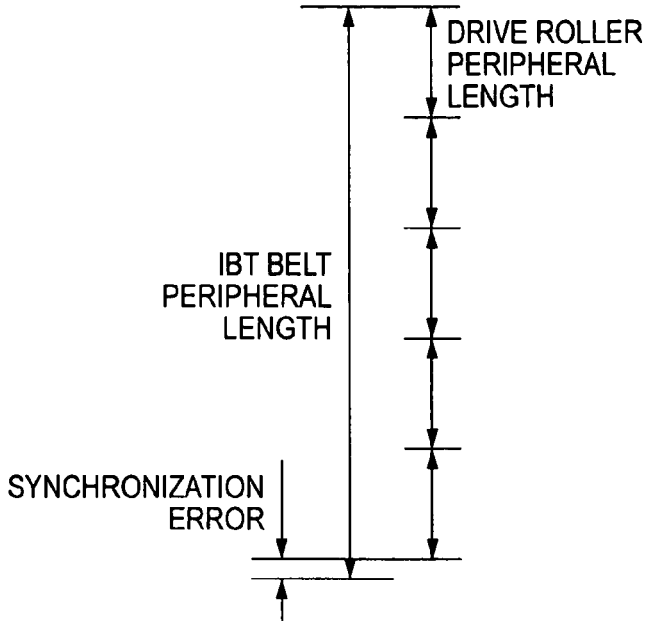
FIG. 6 is an explanatory diagram showing the occurrence of a synchronization error between the intermediate transfer belt and the drive roller.
FIG. 7 is a chart showing a screen angle of a toner image of each color in the color image forming apparatus as the image forming apparatus according to the first embodiment of the invention.

However, as shown in FIG. 3, as the belt cleaner 21 comes out of contact with the surface of the intermediate transfer belt 8 when the toner image of the first color is being transferred from the photoreceptor drum 2, a rotational fluctuation occurs in the intermediate transfer belt 8, causing a misalignment to occur with respect to the toner image of the other colors, as shown in FIG. 5 and FIG. 6.

Furthermore, the rotational fluctuation of the intermediate transfer belt 8 occurs with respect not only to the toner image of the first color, but also to the toner image of the fourth color when the belt cleaner 21 comes into contact with the intermediate transfer belt 8. However, when the belt cleaner 21 comes into contact with the intermediate transfer belt 8, the rotational fluctuation acts in the direction in which the driving force of color. the drive roller 10 is transmitted to the intermediate transfer belt 8, and so on, so that the misalignment of the toner image of the fourth color is small in comparison with that of the first However, according to the embodiment, an image forming apparatus comprises a singular or a plurality of image carrier, and an intermediate transfer belt positioned opposite the image carrier, wherein, during image formation, a plurality of toner images of differing colors are formed in order on the surface of the singular image carrier, or a plurality of toner images of differing colors are respectively formed on the plurality of image carrier, and wherein the toner images formed on the image bear are, after being primarily transferred onto the intermediate transfer belt in a superimposed condition, collectively secondarily transferred from the intermediate transfer belt onto a transfer material. In the image forming apparatus, the configuration is such that, of the screen angles of the toner image of each of the colors formed on the image carrier, the screen angles of two of the colors are set to be approximately identical, and the toner images of the two colors set to be approximately identical in screen angle are consecutively transferred in a superimposed condition onto the intermediate transfer belt.

That is, in the color image forming apparatus according to the embodiment, as shown in FIG. 1, when the toner image of each of the colors yellow (Y), magenta (M), cyan (C) and black (K) is formed on a photoreceptor drum, an electrostatic latent image is formed by applying image exposure to the surface of the photoreceptor drum by unit an optical write unit. The image exposure, however, is configured to be conducted, based on the image information for each color, in such a way that the image for each color is exposed by a laser beam or the like at a prescribed screen angle using a single line screen.

According to the embodiment, as shown in FIG. 7, of the toner images of the 4 colors yellow (Y), magenta (M), cyan (C) and black (K), the screen angle of the toner image of the first color, yellow (Y), is set at 0 degrees, the screen angle of the toner image of the second color, magenta (M), is set at 30 degrees, the screen angle of the toner image of the third color, cyan (C), is set at the same 30 degrees as the screen angle of the second color, magenta (M), and the screen angle of the toner image of the fourth color, black (K), is set at 60 degrees.

That is, as shown in FIGS. 8(A) to (D), the screen angle of the toner image of the first color, yellow (Y), is set at 0 degrees, the screen angle of the toner image of the second color, magenta (M), is set at 30 degrees, the screen angle of the toner image of the third color, cyan (C), is set at the same 30 degrees as the screen angle of the second color, magenta (M), and the screen angle of the toner image of the fourth color, black (K), is set at 60 degrees. Also, a high line frequency, for example, on the order of 250 lpi in photographic image quality is used as a line frequency for the image of each color.

By unit of this configuration, in the case of the color image forming apparatus according to the embodiment, it is possible, in the following way, to reduce the occurrence of a large color drift between two colors with an approximately equivalent screen angle (including an equivalent screen angle), even in a case in which a synchronization error exists between an intermediate transfer body and driving unit which drives the intermediate transfer body.

That is, in the color image forming apparatus 1 according to the embodiment, as shown in FIG. 1, the toner image of each of the colors yellow (Y), magenta (M), cyan (C) and black (K) is formed in order on the surface of the photoreceptor drum 2, but the toner image of each of the colors yellow (Y), magenta (M), cyan (C) and black (K) is formed on the photoreceptor drum 2 by unit of image exposure applied to the surface of the photoreceptor drum 2 at the prescribed screen angle. At this point, as shown in FIGS. 7 and 8 (A) to (D), image exposure is configured to be applied to the toner image of the first color, yellow (Y), at a screen angle of 0 degrees, to the toner image of the second color, magenta (M), at a screen angle of 30 degrees, to the toner image of the third color, cyan (C), at the same 30 degrees as the screen angle of the second color, magenta (M), and to the toner image of the fourth color, black (K), at a screen angle of 60 degrees.

After the toner image for each of the colors yellow (Y), magenta (M), cyan (C) and black (K) formed in order on the surface of the photoreceptor drum 2 is primarily transferred, by unit of the primary transfer roller 7, in a mutually superimposed condition onto the intermediate transfer belt 8, they are secondarily transferred from the intermediate transfer belt 8 onto the transfer paper 17 and fixed by the fuser 19, whereby the color image is formed on the transfer paper 17.

At this point, as shown in FIG. 4, while the toner image of the fourth color is being transferred, the belt cleaner 21 comes into contact with the surface of the intermediate transfer belt 8, thereby cleaning the surface of the intermediate transfer belt 8 in readiness for the next image forming process.

Also, while the next toner image of the first color is being transferred, the belt cleaner 21 is configured to come out of contact with the surface of the intermediate transfer belt 8. In addition, the belt cleaner 21 is also in contact with the surface of the intermediate transfer belt 8 when the image is formed on the first transfer paper 17, before the toner image of the first color is transferred to the surface of the intermediate transfer belt 8, thus cleaning the surface of the intermediate transfer belt 8.

According to the embodiment, however, as shown in FIGS. 7 and 8 (A) to (D), the screen angle of the toner image of the first color, yellow (Y), is set at 0 degrees, the screen angle of the toner images of the second and third colors, magenta (M) and cyan (C), is set at 30 degrees, and the screen angle of the toner image of the fourth color, black (K), is set at 60 degrees. As a result, although the screen angle of the toner images of magenta (M) and cyan (C) are set at the same 30 degrees, as the toner images of magenta (M) and cyan (C) are the second and third colors, the size of the misalignment between the two is extremely small, as shown in FIG. 5. Consequently, even though the magenta (M) and cyan (C) toner images have the same screen angle, there is hardly any noticeable color drift.

Figure 9:
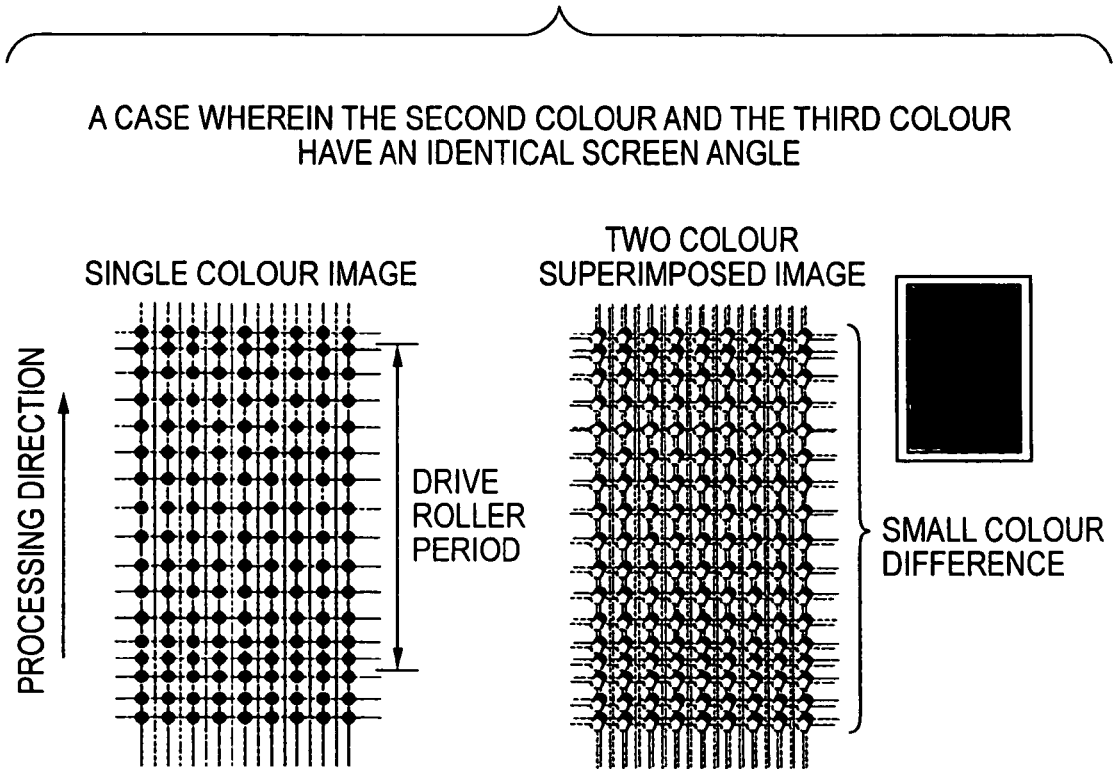
FIG. 9 is a schematic diagram showing a position misalignment in the toner images of a second color and a third color in the color image forming apparatus as the image forming apparatus according to the first embodiment of the invention.

FIG. 9 schematically shows in enlarged dimension an image in the case in which the screen angle of the toner images of the second color and the third color are set to be the same.

As can be clearly seen from FIG. 9, the toner images of the second color and the third color are barely affected by the rotational fluctuation of the intermediate transfer belt 8 and, as they are in a synchronized condition, even in the case that the screen angles of the two are set to be the same, the difference in color drift is small, and the incidence of moire can be controlled.

Also, as shown in FIGS. 7 and 8(A) to (D), the toner images of the first color, yellow, and the fourth color, black, having a screen angle of 0 degrees and 60 degrees, deviate by 30 degrees with respect to each other. Therefore, by imparting differing screen angles, a noticeable amount of deviation can be avoided, even in a case in which a large amount of deviation caused by the rotational fluctuation of the intermediate belt 8 exists in the toner images of the first color, yellow, and the fourth color, black, in particular in the toner image of the first color, yellow.

Figure 10:
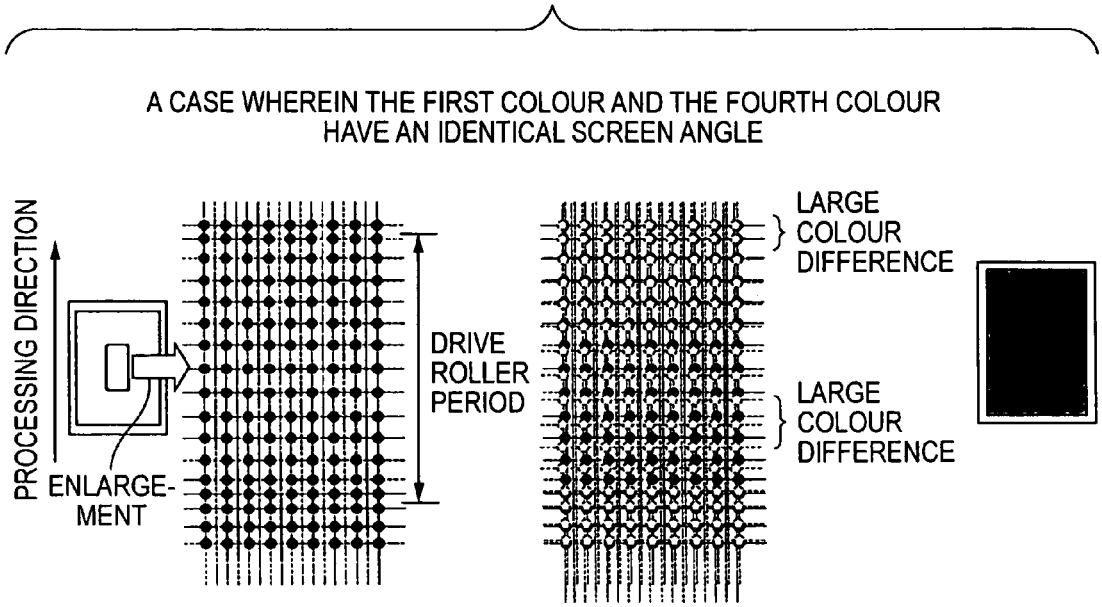
FIG. 10 is a schematic diagram showing a position misalignment in the toner images of a first color and a fourth color in the color image forming apparatus as the image forming apparatus according to the first embodiment of the invention.

Contrarily, in a case in which the screen angle of the toner images of the first color and the fourth color are set to be the same, as shown in FIG. 10, the effect of the rotational fluctuation of the intermediate belt 8 is clearly apparent, and the difference in color drift is large, resulting in a noticeable occurrence of moire.

In this way, according to the embodiment, as with the toner images of the first colour and the fourth colour, even in a case in which a synchronization error exists between the intermediate transfer belt 8 and the drive roller 10 which drives the intermediate transfer belt 8, the screen angles of two colours which have a small synchronization error are set to be equal to each other, and the two colours which have the small synchronization error are printed consecutively, thereby making it possible to reduce the large incidence of colour drift between the two colours, the screen angles of which are equal to each other.

Furthermore, according to the first embodiment, a description has been given of the case in which the screen angles of the toner images of two colours are set to be equal to each other. However, the screen angles of the toner images of two colours need not necessarily be set to be equal to each other, it being sufficient if the settings be made to an approximately equivalent value.

Also, according to the first embodiment, a description has been given of the case in which the first colour is yellow (Y), the second colour is magenta (M), the third colour is cyan (C) and the fourth colour is black (K), but the colour order is not necessarily limited to this, and other arrangements are acceptable.

For example, an explanation has been given of the case in which the first colour is yellow (Y), the second colour is magenta (M), the third colour is cyan (C) and the fourth colour is black (K), but the colour order is not necessarily limited to this. It is acceptable to set the first colour as black (K), the second colour as yellow (Y), the third colour as magenta (M) and the fourth colour as cyan (C), or the first colour as yellow (Y), the second colour as black (K), the third colour as cyan (C) and the fourth colour as magenta (M), as shown in FIGS. 11(A) and (B).

Furthermore, according to the first embodiment, the screen angle of the toner image of the second colour and the screen angle of the toner image of the third colour are set to be the same. However, as shown in FIG. 12, the configuration may be such that the screen angle of the toner image of the third colour and the screen angle of the toner image of the fourth colour are set to be the same.

SECOND EMBODIMENT

FIGS. 13(A) and (B) are diagrams showing a second embodiment of the invention, wherein a description will be given with the same parts as those of the first embodiment indicated by like numerals. The second embodiment is configured to include drive load fluctuation correction unit which corrects the drive load fluctuation of the intermediate transfer belt, which is involved in the movement of the cleaning member into and out of contact with the intermediate transfer belt.

Also, according to the second embodiment, the drive load fluctuation correction unit is configured to include load application unit which corrects the drive load fluctuation of the intermediate transfer belt by applying a drive load to the intermediate transfer belt in response to the movement of the cleaning member into and out of contact with the intermediate transfer belt 8.

That is, the second embodiment is configured not only in such a way that the screen angles of two colours which have a small synchronization error are set to be equal to each other, and the two colours which have the small synchronization error are printed consecutively, as in the first embodiment, but is configured in such a way that the drive load fluctuation occurring in the intermediate transfer belt 8 is corrected as the belt cleaner 21 moves into and out of contact with the surface of the intermediate transfer belt 8.

Figure 13:
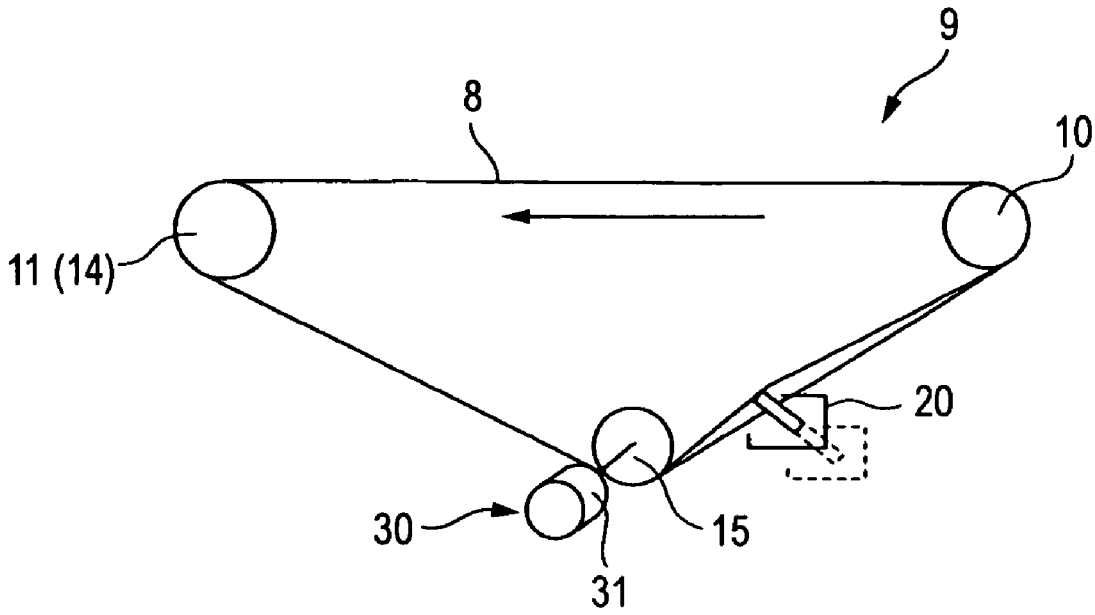
FIGS. 13(A) and (B) are configuration diagrams showing a color image forming apparatus as an image forming apparatus according to a second embodiment of the invention.
Figure 13:
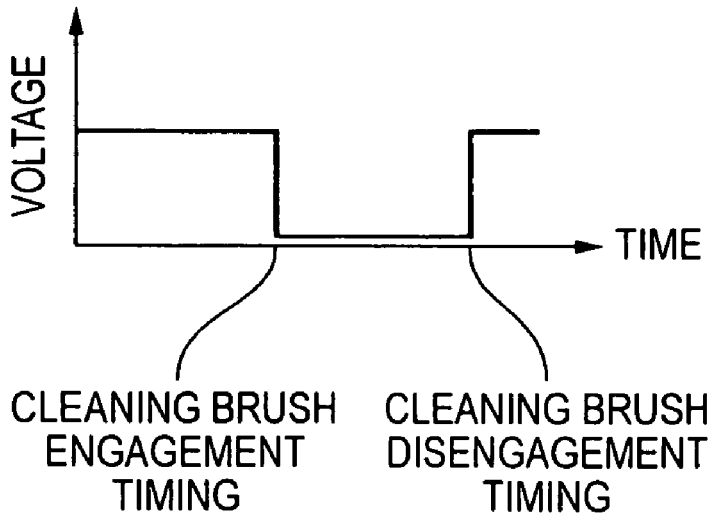

According to the second embodiment, as shown in FIG. 13 (A), a brake 31 is attached to a rotary shaft of the backup roller 15 as load application unit 30. As shown in FIG. 13(B), a brake voltage, which is synchronized with the engaging movement and disengaging movement of the belt cleaner 21, is applied to the brake 30. Normally, a load is applied by the brake 31 to the rotary shaft of the backup roller 15, and the voltage applied to the brake 31 is released only while the belt cleaner 21 is in contact with the intermediate transfer belt 8. The drive load of the intermediate transfer belt 8 can thereby be maintained approximately constant, regardless of the engaging/disengaging movement of the belt cleaner 21.

Figure 14:
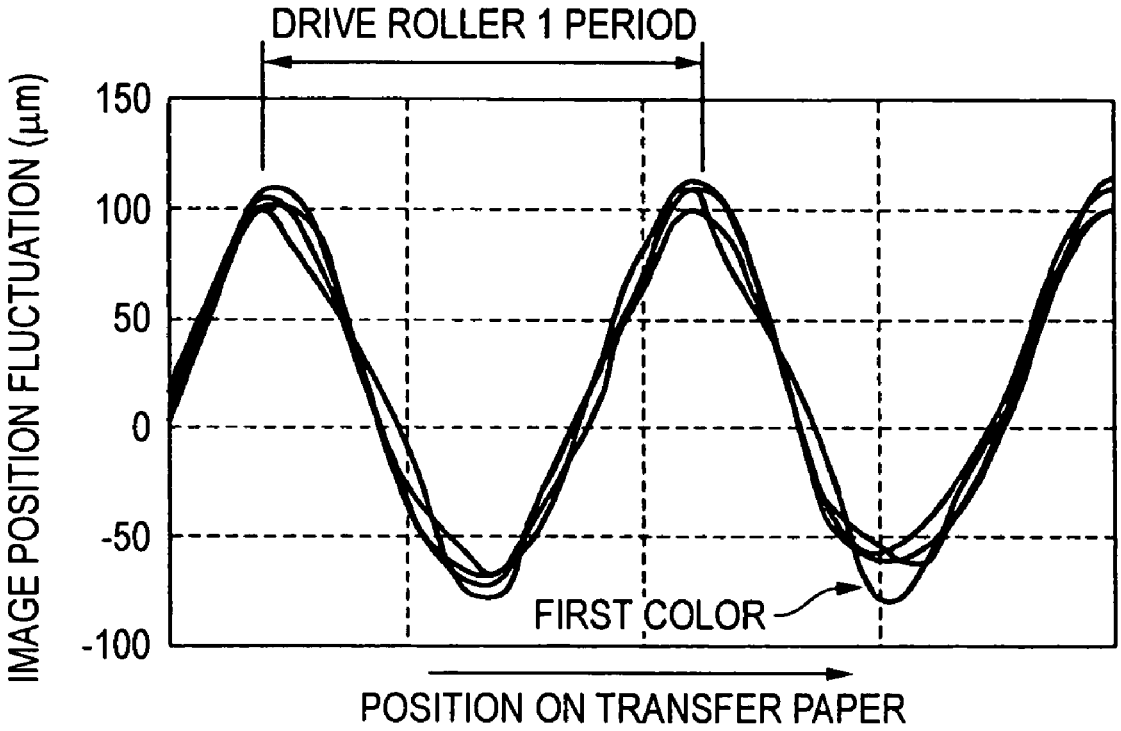
FIG. 14 is a graph showing an image position fluctuation of a toner image of each color which is transferred onto a paper.

As a result, according to the second embodiment, as shown in FIG. 14, image position fluctuations of the first to fourth colours on the intermediate transfer belt 8 can be made approximately the same, meaning that it is possible to further restrain colour drift and moiré from occurring.

However, even in FIG. 14, as the image position fluctuation of the first colour is slightly large in comparison with the other colours, it is necessary that the screen angle of the toner image of the first colour is not set the same as the screen angle of the other toner images.

Furthermore, the drive load fluctuation correction unit is not limited to the brake; it is also acceptable to use unit which displaces a roller for stretching the intermediate transfer belt 8.

As the other configurations and operations are the same as in the first embodiment, a description will be omitted.

THIRD EMBODIMENT

Figure 15:
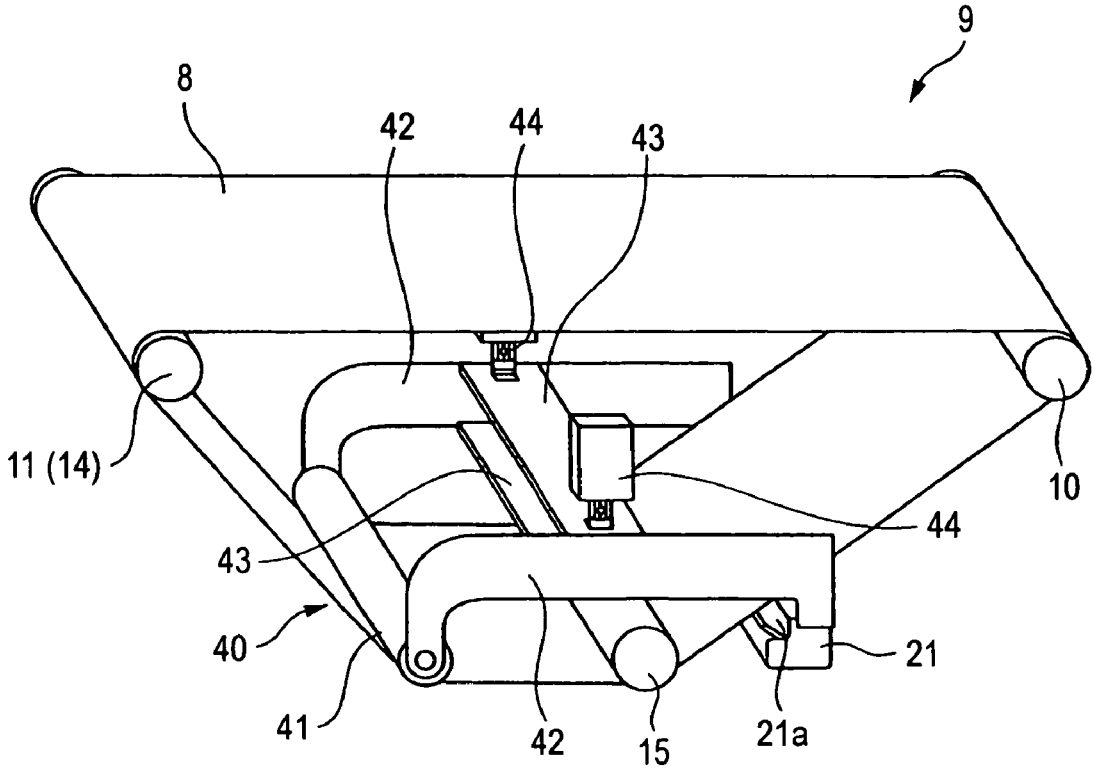
FIG. 15 is a perspective configuration view showing a color image forming apparatus as an image forming apparatus according to a third embodiment of the invention.

FIG. 15 is a view showing the third embodiment of the invention, wherein a description will be given with the same parts as those of the first embodiment indicated by like numerals. The second embodiment is configured to include tension correction unit which corrects a tension fluctuation of the intermediate transfer belt, which is involved in the movement of the cleaning member into and out of contact with the intermediate transfer belt.

Also, the third embodiment is configured in such a way that the tension correction unit is a contact member which corrects the tension fluctuation of the intermediate transfer belt by coming out of contact with the intermediate transfer belt while the cleaning member is in contact with the intermediate transfer belt, and coming into contact with the intermediate transfer belt while the cleaning member is out of contact with the intermediate transfer belt.

Furthermore, the third embodiment is configured in such a way that the contact member is the stretching roller of the intermediate transfer belt.

Also, the third embodiment is configured in such a way that that the contact member is a rear surface belt cleaning member which cleans the rear surface of the intermediate transfer belt.

That is, the third embodiment is configured in the following way. As shown in FIG. 15, tension correction unit 40 is provided on an upstream side of the backup roller 15 which stretches the intermediate transfer belt 8. The tension correction unit 40 includes a second stretching roller 41 which stretches the intermediate transfer belt 8, and also includes the belt cleaner 21 with a blade 21*a*, attached integrally to the opposite side to an arm 42 and 43 which rotatably supports the second stretching roller 41, wherein the arms 42 and 43 are moved vertically according to a prescribed timing, by unit of a solenoid 44.

Figure 16:
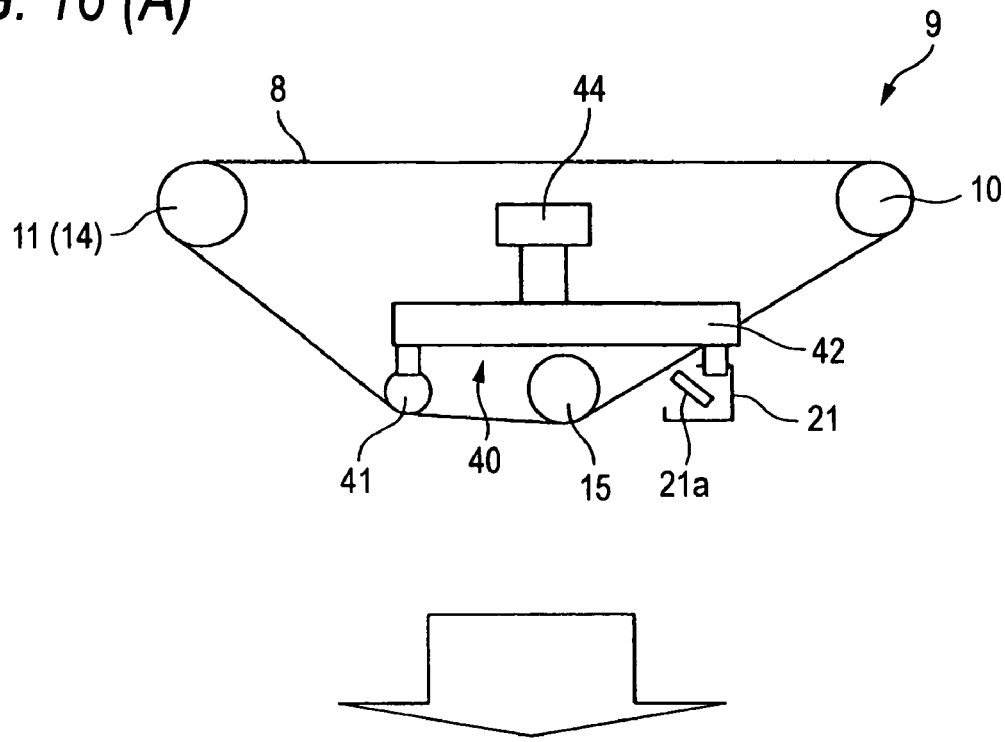
FIGS. 16 (A) and (B) explanatory diagrams showing an operation of the color image forming apparatus as the image forming apparatus according to the third embodiment of the invention.
Figure 16:
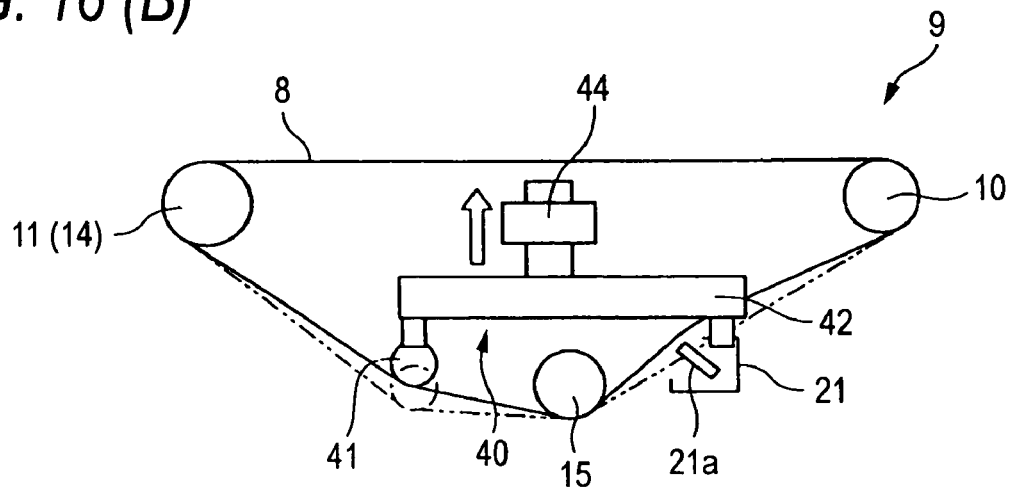

Then, at a normal time of image formation, as shown in the upper portion of FIGS. 16(A) and (B), the solenoid 44 is placed in an off condition, whereby tension is applied to the intermediate transfer belt 8 by the second stretching roller 41, and the blade 21*a* of the belt cleaner 21 is kept out of contact with the intermediate transfer belt 8.

Next, when cleaning the intermediate transfer belt 8, as shown in the lower portion of FIGS. 16(A) and (B), the configuration is such that the solenoid 44 is placed in an on condition, whereby the tension applied to the intermediate transfer belt 8 by the second stretching roller 41 is reduced, and the belt cleaner 21 is brought into contact with the intermediate transfer belt 8, as a result of which the tension of the intermediate transfer belt 8 is corrected so as to be approximately constant.

Figure 17:
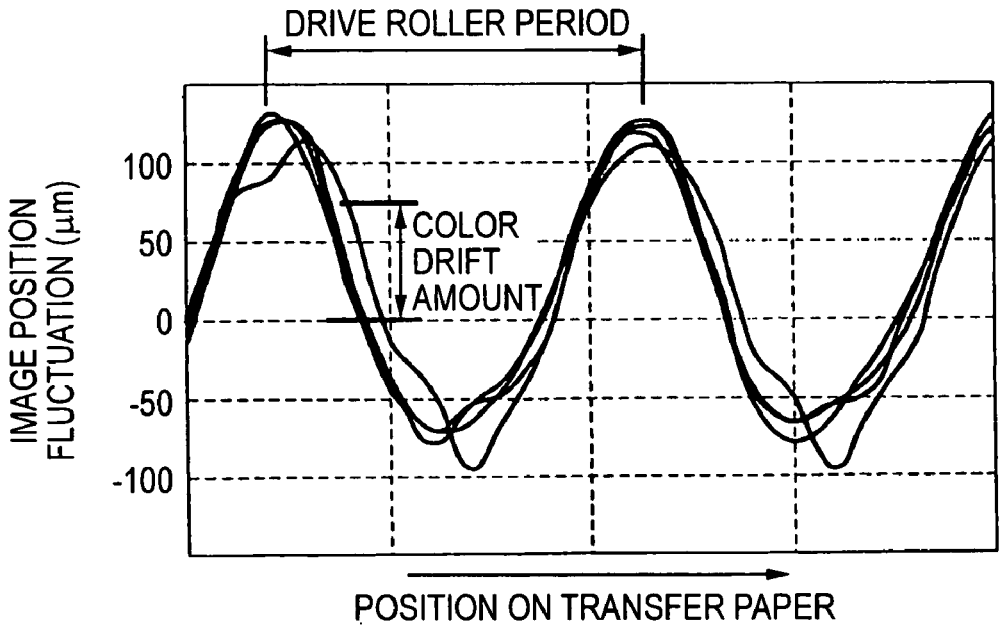
FIGS. 17 (A) and (B) are graphs showing an image position fluctuation of a toner image of each color which is transferred onto a paper.
Figure 17:
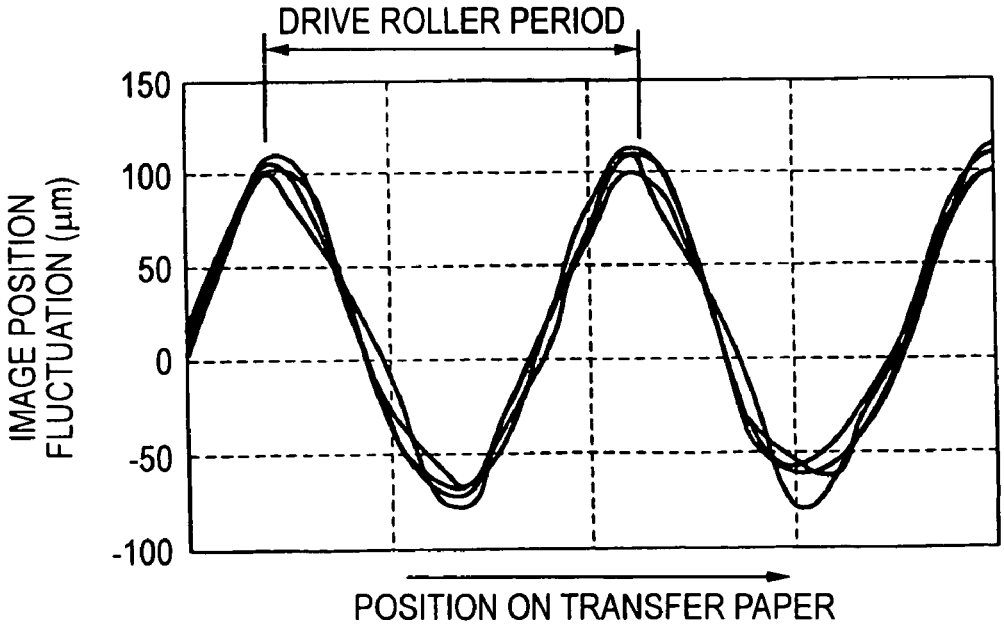

As a result, according to the third embodiment, as shown in FIGS. 17 (A) and (B), image position fluctuations of the first to fourth colours on the intermediate transfer belt 8 can be made approximately the same, meaning that it is possible to further restrain colour drift and moiré from occurring.

Figure 18:
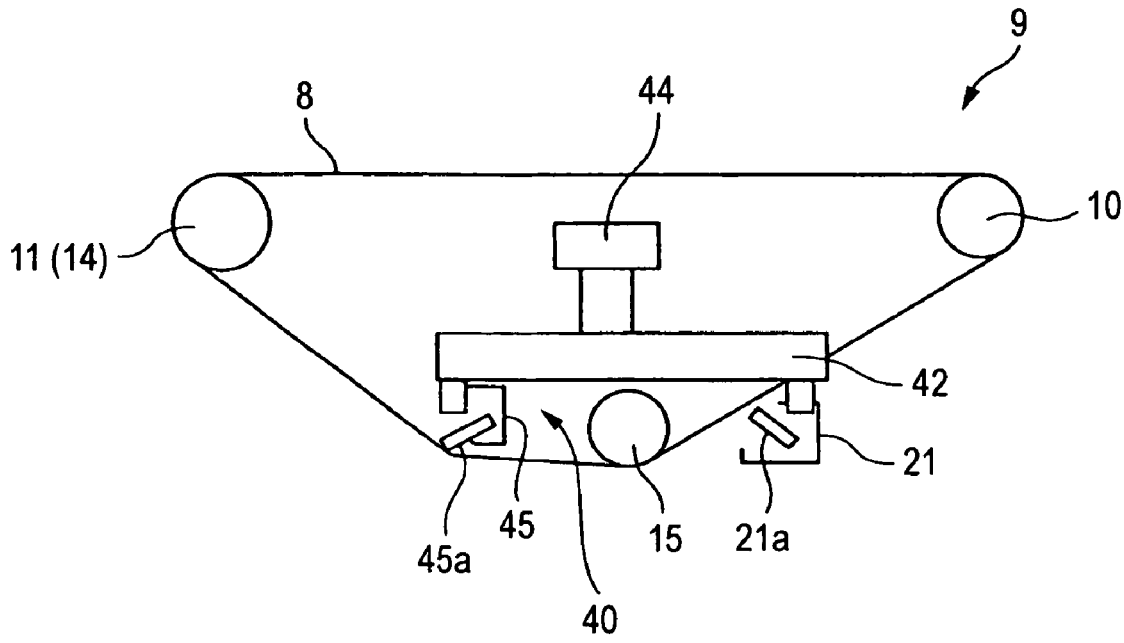
FIG. 18 is a configuration diagram showing a modified example of the color image forming apparatus as the image forming apparatus according to the third embodiment of the invention.

Furthermore, in place of the second stretching roller 40, as shown in FIG. 18, the configuration may be such as to use a rear surface belt cleaning member 45 which includes a blade 45*a* which cleans the rear surface of the intermediate transfer belt 8.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

As the other configurations and operations are the same as in the first embodiment, a description will be omitted.

The entire disclosure of Japanese Patent Application No. 2005-274216 filed on Sep. 21, 2005 including specification, claims, drawings and abstract is incorporated herein by reference in its entirely.

What is claimed is:

1. An image forming apparatus comprising:

an image carrier that a plurality of toner images of differing colors are formed on a surface of the image carrier;

an intermediate transfer belt positioned opposite the image carrier;

an engaging/disengaging member capable of moving into and out of contact with the intermediate transfer belt; and a drive load fluctuation correction unit that corrects the drive load fluctuation of the intermediate transfer belt in accordance with the movement of a cleaning member into and out of contact with the intermediate transfer belt, wherein the toner images formed on the image carrier being primarily transferred onto an intermediate transfer belt in a superimposed condition, and being collectively secondarily transferred from the intermediate transfer belt onto a transfer material, the toner images of two of the colours set to be approximately identical in screen angle being consecutively transferred in a superimposed condition onto the intermediate transfer belt, while the toner images of two of the colours set to be approximately identical in screen angle are being superimposed onto the intermediate transfer belt, the engaging/disengaging member is prohibited to move into or out of contact with the intermediate transfer belt, the engaging/disengaging member corresponds to the cleaning member that cleans the surface of the intermediate transfer belt, and the drive load fluctuation correction unit includes a load application unit that corrects the drive load fluctuation of the intermediate transfer belt by applying a drive load to the intermediate transfer belt in response to the movement of the cleaning member into and out of contact with the intermediate transfer belt.

2. An image forming apparatus according to claim 1, further comprising:

a tension correction unit that corrects the tension fluctuation of the intermediate transfer belt in accordance with the movement of the cleaning member into and out of contact with the intermediate transfer belt.

3. An image forming apparatus according to claim 2, wherein the tension correction unit is a contact member that corrects the tension fluctuation of the intermediate transfer belt by coming out of contact with the intermediate transfer belt while the cleaning member is in contact with the intermediate transfer belt, and by coming into contact with the intermediate transfer belt while the cleaning member is out of contact with the intermediate transfer belt.

4. An image forming apparatus according to claim 3, wherein the contact member is a stretching roller of the intermediate transfer belt.

5. An image forming apparatus according to claim 4, wherein the contact member is a rear surface belt cleaning member which cleans the rear surface of the intermediate transfer belt.

6. An image forming apparatus according to claim 1, wherein a plurality of the image carrier are equipped, and a plurality of toner images of differing colours are respectively formed on the plurality of image carrier.

7. The image forming apparatus according to claim 1, wherein the drive load fluctuation correction unit is a brake.

8. The image forming apparatus according to claim 1, wherein a voltage applied to the drive load fluctuation correction unit is released while the cleaning member is in contact with the intermediate transfer belt.

9. The image forming apparatus according to claim 1, wherein the plurality of toner images of differing colors has a first set of toner images and a second set of toner images, the first set of toner images has first to fourth toner images of differing colors, the second set of toner images has fifth to eighth toner images of differing colors, the first toner image has the same color as the fifth toner image, the fourth toner image has the same color as the eighth toner image, the first toner image to the eighth toner image are successively transferred onto the intermediate transfer belt, the fifth image of the second set is transferred on the intermediate transfer belt after the fourth image of the first set being transferred on the intermediate transfer belt, the cleaning member is in contact with the intermediate transfer belt while the fourth toner image is being transferred to the intermediate transfer belt, and the cleaning member is released from the intermediate transfer belt while the fifth toner image is being transferred to the intermediate transfer belt.

10. An image forming apparatus comprising:

an image carrier that a plurality of toner images of differing colors are formed on a surface of the image earner;

an intermediate transfer belt positioned opposite the image carrier;

an engaging/disengaging member capable of moving into and out of contact with the intermediate transfer belt; and a tension correction unit that corrects the tension fluctuation of the intermediate transfer belt in accordance with the movement of a cleaning member into and out of contact with the intermediate transfer belt, wherein the toner images formed on the image carrier being primarily transferred onto an intermediate transfer belt in a superimposed condition, and being collectively secondarily transferred from the intermediate transfer belt onto a transfer material, the toner images of two of the colours set to be approximately identical in screen angle being consecutively transferred in a superimposed condition onto the intermediate transfer belt, while the toner images of two of the colours set to be approximately identical in screen angle are being superimposed onto the intermediate transfer belt, the engaging/disengaging member is prohibited to move into or out of contact with the intermediate transfer belt, the engaging/disengaging member corresponds to the cleaning member that cleans the surface of the intermediate transfer belt, and the tension correction unit is a contact member that corrects the tension fluctuation of the intermediate transfer belt by coming out of contact with the intermediate transfer belt while the cleaning member is in contact with the intermediate transfer belt, and by coming into contact with the intermediate transfer belt while the cleaning member is out of contact with the intermediate transfer belt.

11. The image forming apparatus according to claim 10, wherein the plurality of toner images of differing colors has a first set of toner images and a second set of toner images, the first set of toner images has first to fourth toner images of differing colors, the second set of toner images has fifth to eighth toner images of differing colors, the first toner image has the same color as the fifth toner image, the fourth toner image has the same color as the eighth toner image, the first toner image to the eighth toner image are successively transferred onto the intermediate transfer belt, the fifth image of the second set is transferred on the intermediate transfer belt after the fourth image of the first set being transferred on the intermediate transfer belt, the cleaning member is in contact with the intermediate transfer belt while the fourth toner image is being transferred to the intermediate transfer belt, and the cleaning member is released from the intermediate transfer belt while the fifth toner image is being transferred to the intermediate transfer belt.

* * * * *